US006042000A

United States Patent [19]

Kawamoto

[11] Patent Number: 6,042,000

[45] **Date of Patent: *Mar. 28, 2000**

[54] MOLD TRAY PROVIDED WITH BENDING SECTION

[75] Inventor: Totaro Kawamoto, Shizuoka, Japan

[73] Assignees: Pulp Mold Packaging Global, Inc., Huntington Beach, Calif.; Fuji Cone Seisakusho Co., Ltd, Fujieda, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/850,432

[22] Filed: May 5, 1997

[30] Foreign Application Priority Data

May 17, 1996 [JP] Japan ..... 8-148095

[51] Int. Cl.[7] ..... B65D 1/00

[52] U.S. Cl. ..... 229/406; 220/839; 206/545; 206/557

[58] Field of Search ..... 206/547, 557, 206/545, 541; 220/336, 337, 339, 340, 341, 4.23, 839; 426/87, 106, 107, 113, 115; 229/406, 938

[56] References Cited

U.S. PATENT DOCUMENTS

| | | | |
|---|---|---|---|
| 3,633,785 | 1/1972 | Cyr | 220/4.23 |
| 3,767,110 | 10/1973 | Congleton | 220/4.23 |
| 3,786,982 | 1/1974 | Rakes et al. | 220/4.23 |
| 4,127,189 | 11/1978 | Shumrak et al. | 220/4.23 |
| 5,151,568 | 9/1992 | Rippley | 220/4.23 |
| 5,270,011 | 12/1993 | Altherr | 220/339 |
| 5,465,901 | 11/1995 | Paine, Jr. | 220/4.23 |
| 5,474,199 | 12/1995 | Julius et al. | 220/339 |
| 5,577,627 | 11/1996 | Richie-Dubler | 220/339 |
| 5,630,508 | 5/1997 | Petit | 220/339 |
| 5,667,094 | 9/1997 | Rapchak et al. | 220/339 |
| 5,683,659 | 11/1997 | Hovatter | 220/339 |

*Primary Examiner*—Paul T. Sewell
*Assistant Examiner*—Luan K. Bui
*Attorney, Agent, or Firm*—Fulwrider Patton Lee & Utecht, LLP

[57] ABSTRACT

A molded tray having a lid section and a storage section, and a method for its manufacture. The molded tray is especially adapted for the storage and service of food products, such as may be made and sold at take-out restaurants. The device comprises a lid section and a storage section interconnected with a bending, or hinge, section. The hinge section is provided with an area of reduced thickness providing a hinge point, and permitting the lid section to overlie the storage section without significant elastic memory so that the lid remains in the closed position adjacent the storage section. The method comprises the deposition of pulp fibers on a carrier net, with a mask plate positioned to prevent deposition of pulp fiber in the location of the area of reduced thickness.

1 Claim, 4 Drawing Sheets

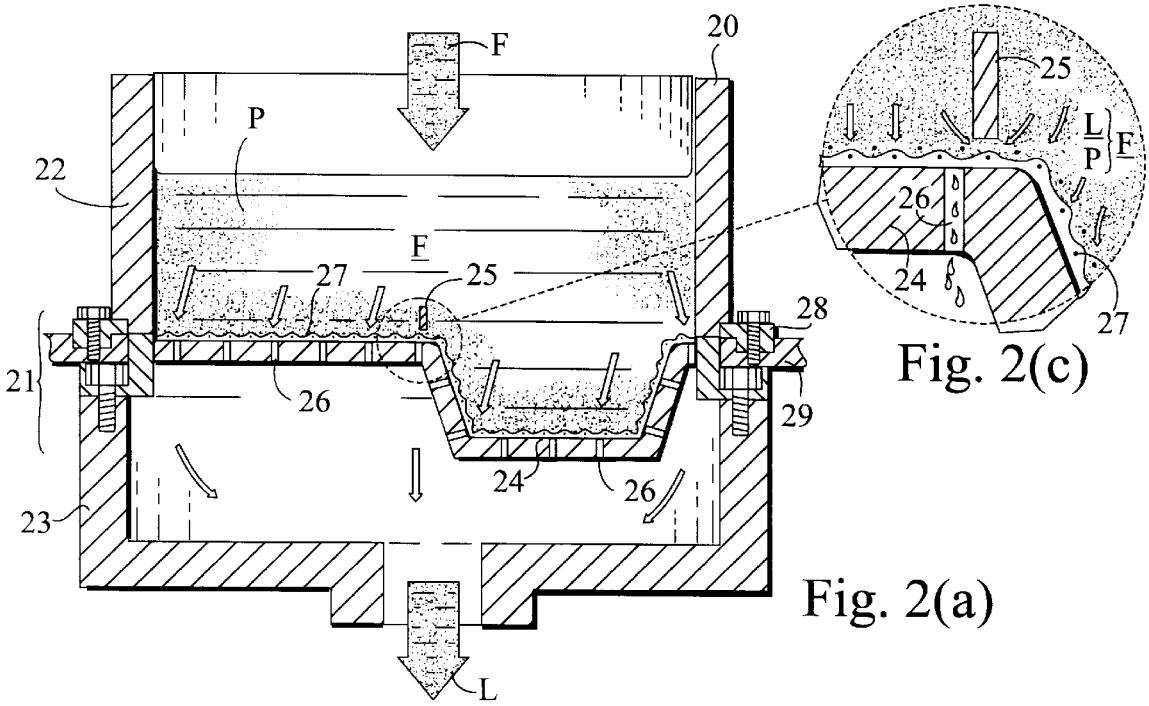
Fig. 2(c)
Fig. 2(a)
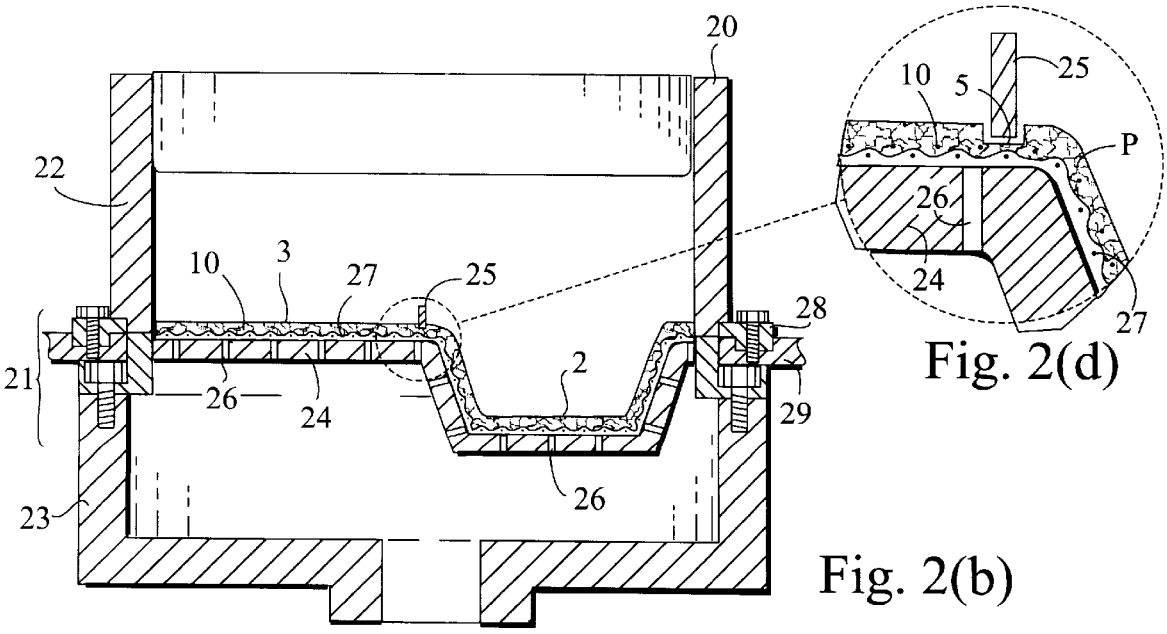
Fig. 2(d)
Fig. 2(b)

MOLD TRAY PROVIDED WITH BENDING SECTION

CROSS-REFERENCE TO RELATED APPLICATIONS

Under 35 U.S.C. 119, applicant claims priority under a foreign patent application filed in the Japanese Patent Office on May 17, 1996, Ser. No. P0896038AS.

STATEMENT REGARDING FEDERALLY SPONSORED RESEARCH OR DEVELOPMENT

Not applicable.

BACKGROUND OF THE INVENTION

Food products are often packaged in molded trays having a hinged or folded lid, manufactured from pulp material. Such products may be made from paper sheet plate stock, and are used as a vessel for storage and service of side dishes, frozen foods, and the like.

Generally speaking, when food products are placed in such trays and displayed for subsequent purchase, the paper trays are wrapped in a plastic wrap (such as polypropelene) so that the food contents can be observed visually prior to purchase. Such trays with paper lids may be used to store food products in a manner wherein the food is not visible. As illustrated in FIG. 4*a* ("Prior Art"), a molded tray 1' is comprised of a storage section 2' and a lid portion 3', and is provided with a hinge section 5' interconnecting the storage and lid sections. Often times the hinge section 5' is cut in on either side 6' to provide a reduced section that must be folded over. When the lid 3' is folded over (in the direction of arrow 7') to the position indicated by phantom lines in FIG. 4*a*, the hinge section 5' (which is merely a web portion of the lid and storage sections) is bent linearly along its length between the cut-in sections 6'.

When the hinge section 5' of prior art devices is not bent properly, the integrity of food stored therein is compromised. Food may spill out, or be exposed to an undesirable amount of ambient air, causing deterioration in food quality. Moreover, if the hinge section 5' is bent insufficiently, the lid 3' may exhibit a spring action, and be subject to returning to its original (open) position. Therefore, it is often necessary to perform the bending action a number of times (FIG. 4*b*) and then securely overlap the lid and storage portions in several spots to assure closure, resulting in excess time being spent in the packaging of the food product.

Some of the disadvantages noted above can be solved by providing a bending section 8' having a reduced thickness when compared with the remainder of the tray. For example, as illustrated in FIG. 4*c*, the bending section 8' may be provided by impressing or embossing a transverse area about which the lid 3' may rotate. Such an additional step necessarily adds both complexity and cost to the finished price of the product. Furthermore, when provided as illustrated in FIG. 4*c*, the "memory" of the lid section tends to create a spring-action which prevents the lid from lying adjacent the storage section in a closed position of its own weight. Accordingly, the device must be provided with closure means to maintain the lid closed, further adding to the cost and complexity of the device.

The process and product of the present invention is intended to resolve these and other problems by providing a process for the manufacture of a novel tray/lid combination wherein the lid can be bent easily and thereafter remain securely in the "closed" condition.

BRIEF SUMMARY OF THE INVENTION

The present invention comprises both an apparatus and process to make a molded tray/lid assembly, and the product made thereby. The molded tray is provided with a bending section formed by a novel molding process wherein pulp fiber is used as a main raw material and the pulp fiber is molded such that a storage section and a lid section are interconnected by a bending section. A portion of the bending section is formed in a manner that it is thinner than the remainder of the molded tray. The thin wall of the bending section can be bent securely and interlocked with the storage section when the lid is properly overlapped with the storage section.

Pulp fiber is used as the primary raw material in formation of the product of the present invention. Pulp fiber is provided in a stock solution to a mold, with the liquid being withdrawn, leaving the fiber on a mold having the proper configuration. With the bending section having a thinner wall, the bending action is accomplished more easily and the lid remains in the secured configuration with the storage section. The lid is secured in a manner that the spring-back action experienced by the prior art is eliminated or reduced significantly.

Because the bending section is formed during initial formation of the entire unit, the additional step of forming the bending section is eliminated.

BRIEF DESCRIPTION OF THE SEVERAL VIEWS OF THE DRAWINGS

FIG. 2*a* is a sectional view of an apparatus to practice the process for manufacturing the product of FIG. 1, during formation of such product;

FIG. 2*b* is a sectional view similar to that of FIG. 2*a*, later in the process after formation of the product;

FIG. 2*c* is an enlarged view of a portion of FIG. 2*a;*

FIG. 2*d* is an enlarged view of a portion of FIG. 2*b;*

DETAILED DESCRIPTION OF THE INVENTION

Figures 1, 1A:
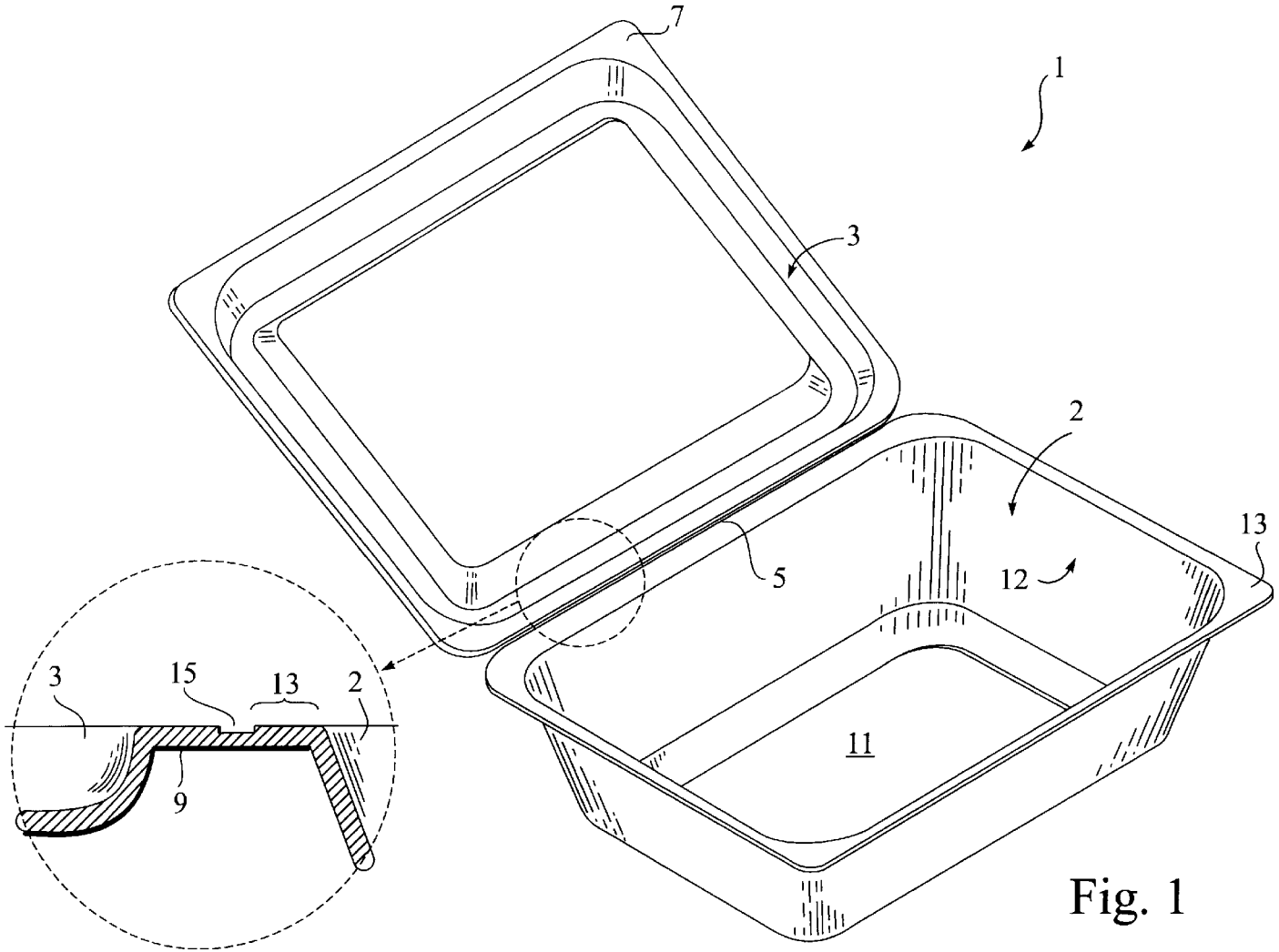
FIG. 1 is a perspective view of the novel tray/lid combination of the present invention.
FIG. 1*a* is an enlarged portion of the hinge section of FIG. 1.

The molded tray/lid apparatus 1 of the present invention is illustrated generally in FIG. 1. In one embodiment, the apparatus is formed by using pulp fiber as a main raw material. In a preferred embodiment, the device comprises a rectangular storage section 2 having a bottom plate 11, and a plurality of side plates 12 which rise from the bottom plates to form the sides of the storage section. The storage section 2 is formed with a flange section 13 about the upper circumference of the section, which extends beyond the side plates 12 in the nature of a collar.

A lid section 3 is formed in the same rectangular shape as the storage section, and is adapted to interfit therewith. The lid section is likewise provided with a flange section 7 which may be designed to either overlie the flange 13 or interfit therewith.

The lid section 3 is formed continuously and integrally in one piece with the storage section, interconnected with a bending, or hinge, section 5. As illustrated in more detail in FIG. 1*a*, the bending section 5 comprises a web of material 9 having an area 15 of reduced thickness therein about which the lid section 3 pivots to enclose the storage section 2. The thickness of the area 15 is determined based upon the properties of the materials of construction, the nature of the agent to be added internally, and the length of the flange sections 7, 13. One of the flanges 7, 13 may be provided with locking means (not shown) to secure the flanges in a closed condition.

The manufacture of the mold tray/lid apparatus of the present invention may be effected with wood pulp as the material of construction. As illustrated in FIGS. 2*a* and 2*b*, a mold tray forming device 20 to form the present invention comprises a forming cylinder 22 and a receiving cylinder 23. A mold tray forming cup 21, with a carrier net 27 thereon, is interposed therebetween, and comprises forming members adapted to form a device in the desired configuration.

An aqueous stock solution F, containing a predetermined amount of pulp fibers P is introduced into the forming cylinder 22, to be deposited upon a first side of the support member 24 in the form of the tray/lid apparatus of the present invention. A vacuum is applied to the receiving cylinder so that liquid L from the pulp slurry is withdrawn through the support member 24 and the carrier net 27, leaving a layer of pulp P retained on the carrier net. The support member 24 is provided with a plurality of liquid discharge apertures 26 through which the liquid is evacuated (in the direction of the arrows in FIG. 2*a*). The process disclosed herein is analogous to that disclosed in copending U.S. patent application Ser. No. 08/753,163.

The support member 24 and the carrier net 27 are provided in the same general configuration as the desired end product 1. The carrier net and the support member are retained between the forming cylinder 22 and the receiving cylinder 23 by a press ring 28 and a mounting plate 29. Affixed to the inner surface of the forming cylinder 22 is a mask plate 25 across a substantial portion of what will become the web 9, to produce the area of reduced thickness 15 as the site for bending of the lid section 3 to engage the storage section 2. The mask plate 25 is provided with a thickness having the same width dimension as desired for the area 15. In a preferred embodiment, the mask plate 25 has a thickness dimension of about 2 mm.

The mask plate is provided with a lower end adjacent to, but separated from, the carrier web. The separation distance between the plate 25 and carrier web 27 is equal to the thickness of the area 15, which in the preferred embodiment is approximately 1.5 mm. The mask plate may be securely affixed to the inner wall of the forming cylinder 22, or it may be removably affixed so as to provide alternative thicknesses and separation distances for other embodiments of the invention. Likewise, the position of attachment of the mask plate may be adjustable to interfit with different support members 24 and carrier webs 27.

In use, the stock pulp slurry F is introduced into the forming cylinder 22, the vacuum (not shown) is activated, and fluid L is withdrawn from the receiving cylinder 23. As the slurry is dewatered, the pulp fibers P are deposited on the carrier net 27 in a pre-form 10. The pulp P is formed into the desired configuration of the device, with the deposition occurring around the mask plate 25. Differences in the thickness of the area 15 and the remainder of the device can be controlled by adjusting the size and number of the liquid discharge apertures 26 and the size of the mesh of the carrier net 27.

The pre-form 10 is formed as a solid member after initial dewatering of the slurry, and remains on the carrier net 27 as illustrated in FIG. 2*b*. The pre-form 10 is transferred to a drying station, either by removing the carrier net, or if it has sufficient internal rigidity, by removing the device from the carrier net. The mask plate 25 may be removed in order to extract the pre-form 10.

Figure 3B:
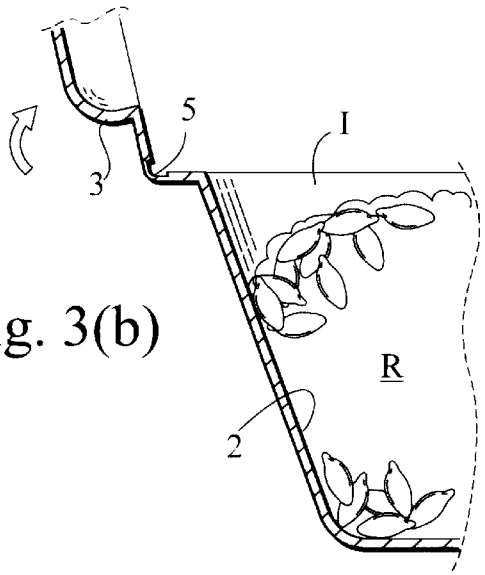
FIGS. 3*a–d* are a partial sectional view of the product of FIG. 1 illustrating closure of the product.
Figure 3D:
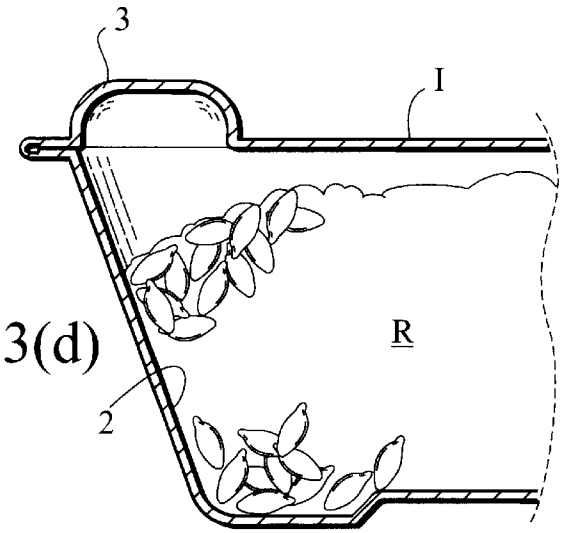
Figure 3A:
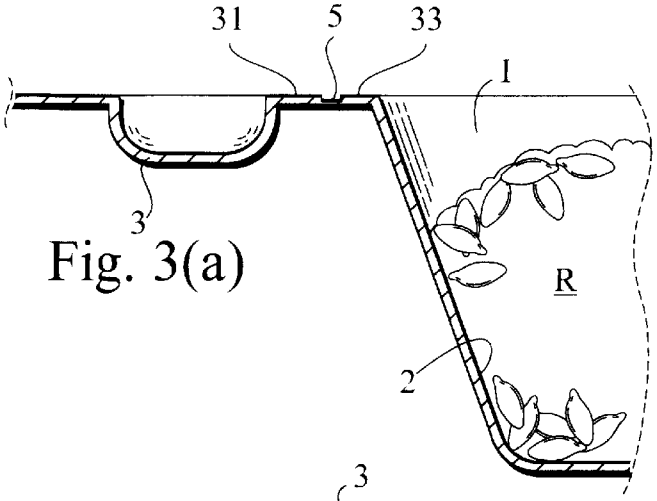
Figure 3C:
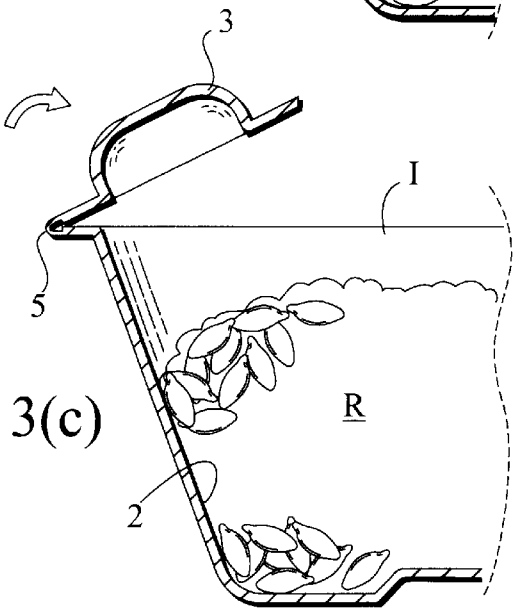
Figure 4A:
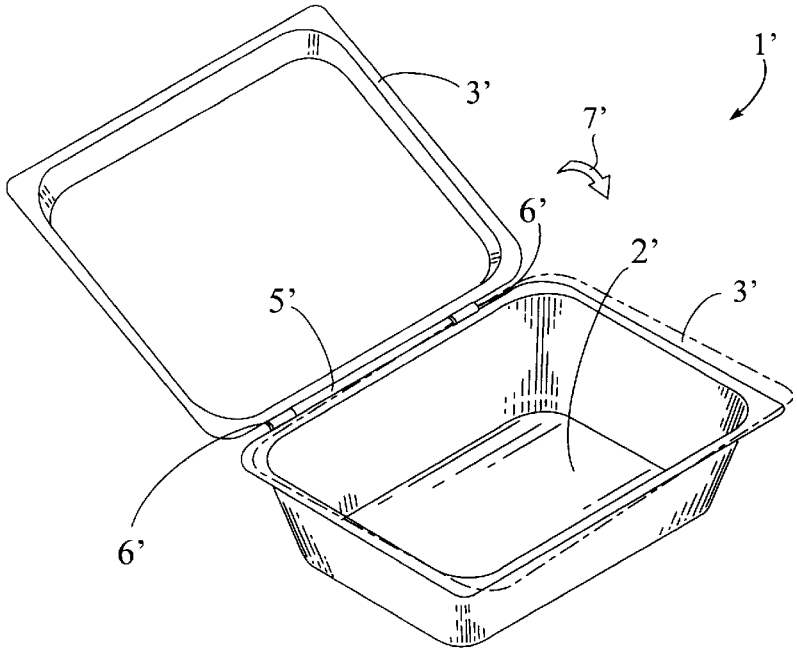
Fig. 4(a) Prior Art
FIG. 4*a* is a perspective view of a Prior Art apparatus.
Figure 4B:
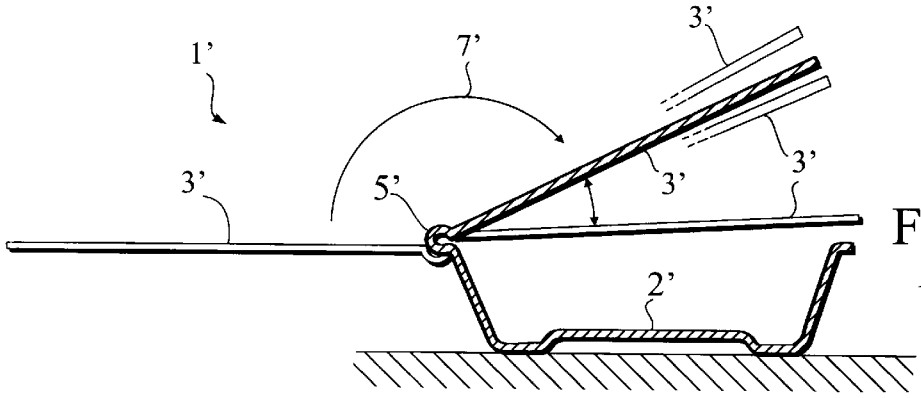
Fig. 4(b) Prior Art
FIG. 4*b* is a sectional view illustrating closure of the device of FIG. 4*a*.
Figure 4C:
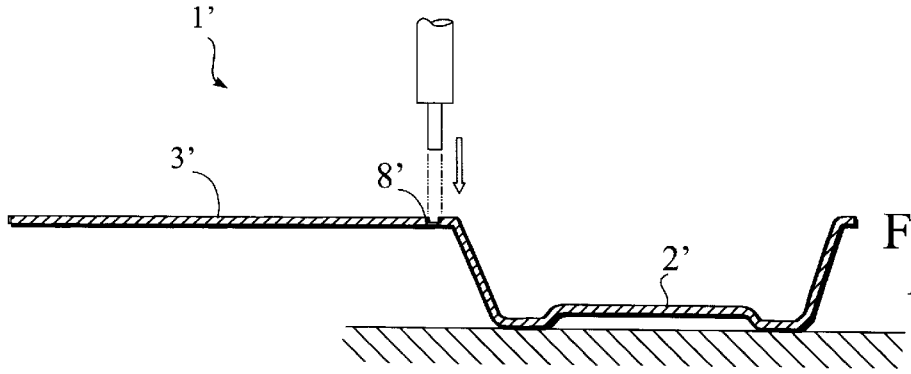
Fig. 4(c) Prior Art
FIG. 4*c* is a sectional view of a portion of the process to form a Prior Art device.

The device of the present invention is preferably stored in the nested condition, wherein the lid is extended fully from the storage section as illustrated in FIG. 3*a*. Upon use, a single device is removed, food products such as rice R are placed in the storage section 2, and the lid section 3 is bent through an arc into engagement with the storage section (FIGS. 3*b*–3*d*). When constructed of materials such as pulp fiber, that tend to accept a new position without a great deal of elastic memory, the lid section will tend to overlie the storage section without the need of retaining devices, as its own weight tends to maintain the lid in engagement with the storage section (FIG. 3*d*). The apparatus of the present invention may be used at, for example, a store wherein food products are prepared for consumption off-premises, such as occurs in many take-out Japanese restaurants.

The transverse dimension of the area of reduced thickness 15 must be sufficient to permit the hinge action illustrated in FIGS. 3*a*–*d*. That is, the dimension must be adequate to permit the flange 31 of the lid section to be pivoted into engagement with the flange 33 of the storage section, so that they may rest in engagement with one another (FIG. 3*d*) without effecting a spring action that tends to open the lid section.

A particular embodiment of the invention has been shown and described herein. It is to be appreciated that numerous modifications and alterations to this embodiment may be made within the scope of this invention. Accordingly, the scope of this invention should be determined solely by the scope of the claims appended hereto.

What is claimed is:

1. An apparatus for storage of food products comprising:

a. a storage section having a bottom and side walls, and having a flange attached to and projecting from an upper rim of the side storage section;

b. a lid section having a circumferential flange adapted to interfit with the flange of the upper rim of the storage section;

c. a bending section forming a hinge between the lid section and the storage section; and d. a slot positioned on an interior side of the bending section, the slot extending the entire length of the hinge and having a transverse dimension sufficient to permit the flange of the lid section to lie adjacent the flange of the storage section when the lid is rotated into engagement with the storage section wherein the storage section, lid section and bending section are of substantially uniform density and are integrally formed using pulp fiber.

* * * * *